United States Patent [19]

Perisastry et al.

[11] Patent Number: 4,655,668

[45] Date of Patent: Apr. 7, 1987

[54] PROJECTILE STORAGE RACK WITH GANG LOCK MECHANISM

[75] Inventors: Ayyala Perisastry, Dover; Richard A. Vishe, Spring Groove; Henry J. Huber, Reading, all of Pa.

[73] Assignee: Harsco Corporation, Camp Hill, Pa.

[21] Appl. No.: 573,414

[22] Filed: Jan. 24, 1984

[51] Int. Cl.[4] ..... F42B 37/00

[52] U.S. Cl. ..... 414/417; 206/3; 206/443; 206/804; 211/60.1

[58] Field of Search ..... 414/267, 280, 417; 89/1.58, 1.59, 34; 206/3, 443, 592, 804; 211/8, 59.3, 60.1, 13, 49.1, 89

[56] References Cited

U.S. PATENT DOCUMENTS

| | | | |
|---|---|---|---|
| 918,606 | 4/1909 | Stillwell | 206/3 |
| 2,237,712 | 4/1941 | Mullins | 206/3 X |
| 2,379,383 | 6/1945 | Steel | 206/3 X |
| 2,432,802 | 12/1947 | Reynolds | 206/3 X |
| 2,445,423 | 7/1948 | Eastman | 211/13 |
| 2,525,551 | 10/1950 | Keith | 211/13 |
| 2,593,472 | 4/1952 | McGinn | 211/13 |
| 2,722,307 | 11/1955 | Burke et al. | 206/3 |
| 2,762,514 | 9/1956 | McGinn | 211/13 |
| 2,766,660 | 10/1956 | Laddon et al. | 206/3 X |
| 2,822,730 | 2/1958 | Brennan et al. | 206/3 X |
| 2,966,827 | 1/1961 | Harvey | 206/3 |
| 3,072,022 | 1/1963 | Wood et al. | 89/1.806 |
| 3,444,780 | 5/1969 | Fusee | 206/3 X |
| 3,888,346 | 6/1975 | Lancaster | 206/3 |
| 3,998,268 | 12/1976 | Sagan | 211/60.1 X |
| 4,099,626 | 7/1978 | Magnussen, Jr. | 211/60.1 X |
| 4,236,441 | 12/1980 | Turner et al. | 89/40 F |
| 4,344,528 | 8/1982 | Perisastry et al. | 206/3 |
| 4,476,988 | 10/1984 | Tanner | 206/3 X |
| 4,508,215 | 4/1985 | Swarthout | 206/443 X |
| 4,538,724 | 9/1985 | Johnson | 206/3 |

*Primary Examiner*—Robert J. Spar
*Assistant Examiner*—David A. Bucci
*Attorney, Agent, or Firm*—Kerkam, Stowell, Kondracki & Clarke

[57] ABSTRACT

A projectile storage rack includes a gang locking mechanism for simultaneously locking and unlocking a number of projectiles disposed within corresponding cylindrical projectile storage tubes. Each projectile storage tube has a corresponding clamping surface for clamping a projectile within that storage tube. A number of locking bars are pivotable mounted upon the storage tubes and provide support for the clamping surfaces. Right and left pivotable handles are used for causing the locking bars to pivot, thereby moving the clamping surfaces between a clamping position in which they hold projectiles within the tube and a nonclamping position in which projectile may be easily removed from the storage tubes.

16 Claims, 9 Drawing Figures

PROJECTILE STORAGE RACK WITH GANG LOCK MECHANISM

The U.S. Government has rights in this invention pursuant to Contract No. DAAE07-81-C-4024 awarded by the Department of the Army.

BACKGROUND OF THE INVENTION

This invention relates to racks used for storage and transportation of projectiles. More specifically, this invention relates to a projectile rack having a gang locking mechanism to securely hold projectiles within a plurality of parallel horizontally disposed storage tubes.

The modern war is often a war of logistics where the winner is determined by the ability to efficiently transport men and material. Accordingly, it is essential to optimize the conveyance of projectiles, shells, and more generally ammunition.

For simplicity, "projectiles" as used herein shall be considered to include shells, missiles, torpedos, bombs, and more generally ammunition.

The storage or transportion of projectiles generally requires a balancing between two conflicting considerations. On the one hand, the projectiles should be stored such that it is easy to remove them from their storage rack or other storage mechanism. On the other hand, the projectiles must be stored such that they are secure in their storage arrangement and will not be jarred loose by nearby explosions or while being transported along a bumpy road. Generally, the more secure a projectile is from accidental dislodgement, the more tedious it is to remove the projectile from its storage facility.

Typically, the transportation and storage of howitzer projectiles uses disposable wooden pallets holding 8 projectiles which are retained in the pallet by a wooden top and held together by steel straps or bands. The projectiles are stored and transported in the vertical position. Despite the simplicity and relative low cost of this packaging arrangement, it does have major disadvantages, especially in the field.

One disadvantage is the fact that, if only one or two projectiles are required for immediate use, the pallet must be broken (i.e., the straps removed). The remaining projectiles must be either rebanded (not always possible or convenient), or manually lifted and securely mounted aboard a vehicle for further transportation during relocation of a howitzer or for other purposes. The resecuring of the remaining projectiles is a time consuming step and could lead to the abandonment of the projectiles if an enemy attacks in force.

Another major disadvantage of the wooden pallet arrangement is that it is incompatible with the relatively new ammunition supply vehicles which require projectiles to be disposed horizontally in order to achieve maximum storage density. Further, the fusing and handling of the projectiles to load howitzers is more efficiently handled when the projectiles are disposed horizontally or almost horizontally, whereas the wooden pallet method stores the projectiles vertically.

Some of the prior art problems with storage and transportation of projectiles have been overcome by the PROJECTILE LOCK ASSEMBLY disclosed in U.S. Pat. No. 4,344,528, issued Aug. 17, 1982 to Ayyala Perisastry, Richard A Vishe, and Peter J. Hoet. The projectile lock assembly disclosed in that patent uses a plurality of parallel cylindrical tubes as a rack. More importantly, a number of locking assemblies are mounted along each of the tubes and used for individually locking projectiles within the associated tube.

The projectile lock assembly is advantageous in that projectiles may be separately locked and unlocked. However, with this assembly one must individually lock and unlock each and every projectile. This process takes time which could be used more profitably under battlefield conditions.

OBJECTS AND SUMMARY OF THE INVENTION

Accordingly, it is a primary object of the present invention to provide a new and improved projectile storage rack and associated gang locking mechanism.

A more specific object of the present invention is to provide a gang lock mechanism which may quickly lock and unlock a plurality of projectiles in a storage rack.

Yet another object of the present invention is to provide a gang lock mechanism which may be used with the projectiles stored in horizontal position to provide ready access to the nose of the projectile and to allow unloading of the projectile by its nose end.

A still further object of the preset invention is to provide a projectile storage rack having a gang lock mechanism which is easy and convenient to operate without additional tools.

A still further object of the present invention is to provide a projectile storage rack with sufficient mechanical advantage such that great manual strength is not required to lock or unlock the projectiles.

Yet another object of the present invention is to provide a gang lock mechanism which takes up a minimal amount of space such that the projectile storage density within the associated storage rack may be quite high.

The above and other objects of the present invention which will become apparent as the description proceeds are realized by a projectile storage rack having a front, a back, a right side, and a left side and comprising: a plurality of parallel projectile storage compartments arranged in at least one row; a plurality of clamping surfaces, each clamping surface associated on a one-to-one basis with one of the storage compartments, each clamping surface movable between; (i) a clamping position in which it is operable to clamp a projectile within its associated storage compartment, and (ii) a nonclamping position such that projectiles may be freely inserted and removed from the associated storage compartment; an operator mechanism operable to move more than one of the clamping surfaces between their respective clamping positions and non-clamping positions, the operator mechanism disposable in; (i) an activation position in which the operator mechanism disposes the more than one clamping surface in their clamping positions, and an inactivation position in which the operator mechanism disposes the more than one clamping surfaces in their non-clamping positions, the operator mechanism being lockable in the activation position. The operator mechanism includes a pivotable first handle extending from the front towards the back and a pivotable second handle, the first and second handles disposed on opposite sides of the projectile storage rack and pivotable about a common pivot axis extending between right and left at the back of the projectile storage rack. The storage rack further comprises a plurality of parallel cylindrical tubes defining the plurality of projectile storage compartments, the operator mechanism including a plurality of locking bars extending front to back. Each locking bar is pivotably mounted on its front end to at least one associated tube and supports at least one clamping surface. The locking bars are pivotable by operation of the operator mechanism. The operator mechanism includes at least a first activation rod extending right to left and disposed at the back, the first activation rod movable up and down as the operator mechanism changes position. The plurality of projectile storage compartments are arranged in at least two rows, and the operator mechanism is operable to move clamping surfaces associated with storage compartments in the at least two rows. The first activation rod is operable to cause at least some of the locking bars to pivot.

The present invention may alternately be described as a projectile storage rack having a front, a back, a right side, and a left side and comprising: a plurality of parallel projectile storage compartments arranged in at least one row; a plurality of clamping surfaces, each clamping surface associated on a one-to-one basis with one of the storage compartments, each clamping surface movable between (i) a clamping position in which it is operable to clamp a projectile within its associated storage compartment, and (ii) a non-clamping position such that projectiles may be freely inserted and removed from the associated storage compartment; an operator mechanism operable to move more than one of the clamping surfaces between their respective clamping positions and nonclamping positions, the operator mechanism disposable in; (i) an activation position in which the operator mechanism disposes the more than one clamping surfaces in their clamping positions, and (ii) an inactivation position in which the operator mechanism disposes the more than one clamping surfaces in their nonclamping positions, the operator mechanism being lockable in the activation position, and wherein the operator mechanism includes at least one pivotable handle. A first activation rod is operable to cause at least some of a plurality of locking bars to pivot. A second activation rod extending right to left and disposed at the back is movable up and down as the operator mechanism changes position. The second activation rod is operable to cause at least some of the locking bars to pivot. The operator mechanism has a mechanical advantage of at least 10:1.

The present invention may alternately be described as a projectile storage rack having a front, a back, a right side, and a left side and comprising: a plurality of parallel projectile storage compartments arranged in at least one row; a plurality of clamping surfaces, each clamping surface associated on a one-to-one basis with one of the storage compartments, each clamping surface movable between: (i) a clamping position in which it is operable to clamp a projectile within its associated storage compartment, and (ii) a non-clamping position such that projectiles may be freely inserted and removed from the associated storage compartment; an operator mechanism operable to move more then one of the clamping surfaces between their respective clamping positions and non-clamping positions, the operator mechanism disposable in: (i) a activation position in which the operator mechanism disposes the more than one clamping surfaces in their clamping positions, and (ii) an inactivation position in which the operator mechanism disposes the more than one clamping surfaces in their non-clamping positions, the operator mechanism being lockable in the activation position, and wherein the operator mechanism includes at least a first activation rod extending right to left and disposed at the back, the activation rod movable up and down as the operator mechanism changes position, and wherein movement of the first activation rod causes a change in position of at least some of the clamping surfaces. The operator mechanism includes a second activation rod extending right to left and disposed at the back, the second activation rod movable up and down as the operator mechanism changes position, and movement of the second activation rod causes a change in position of at least some of the clamping surfaces, and wherein the first activation rod is operable to activate the clamping surfaces associated with one of the rows and the second activation rod is operable to activate the clamping surfaces associated with another of the rows. Each of the locking bars is associated with one of the at least two rows, and each locking bar is pivotably mounted and is secured to an associated one of the first and second activation rods for pivoting upon up and down movement of the associated one of the first and second locking bars. The operator mechanism includes pivotable first and second handles.

The present invention may alternately be described as a projectile storage rack having a front, a back, a right side, and a left side and comprising: a plurality of parallel projectile storage compartments arranged in at least one row; a plurality of clamping surfaces, each clamping surface associated on a one-to-one basis with one of the storage compartments, each clamping surface movable between: (i) a clamping position in which it is operable to clamp a projectile within its associated storage compartment, and (ii) a non-clamping position such that projectiles may be freely inserted and removed from the associated storage compartment; an operator mechanism operable to move more than one of the clamping surfaces between their respective clamping positions and nonclamping positions, the operator mechanism disposable in: (i) an activation position in which the operator mechanism disposes the more than one clamping surfaces in their clamping positions, and an inactivation position in which the operator mechanism disposes the more than one clamping surfaces in their nonclamping positions, the operator mechanism being lockable in the activation position, and further comprising a plurality of parallel cylindrical tubes defining the plurality of projectile storage compartments, the operator mechanism including a plurality of locking bars extending front to back, each locking bar supporting at least one clamping surface. The operator mechanism includes a first activation rod operable to activate at least some of the clamping surfaces by causing at least some of the locking bars to move. Each of the locking bars is pivotably mounted. The operator mechanism includes a second activation rod, each activation rod extending across an associated one of the two rows and attached to locking bars associated with that row. The projectile storage rack further comprises a plurality of projectile extracting rods, each projectile extracting rod attached to an associated one of the cylindrical tubes and operable to remove a projectile from the associated one of the cylindrical tubes.

BRIEF DESCRIPTION OF THE DRAWINGS

The above and other objects and feature of the present invention will be more readily understood when considered in conjunction with the following detailed description and the accompanying drawings wherein like characters represent like parts throughout the several views and in which.

DETAILED DESCRIPTION OF THE DRAWINGS

Considering now FIGS. 1, 2, 3 and 5 the basic features of the storage rack 10 including gang lock mechanism 12 will be discussed initially.

The storage rack 10 includes a number of upper parallel cylindrical tubes 14U and lower parallel cylindrical tubes 14B. The tubes 14U and 14B define an associated projectile storage compartments 16U and 16B disposed within each tube. Each of the projectile storage compartments 16U and 16B accommodates a single projectile the tubes 14U and 14B are welded together with gussets 18 added for extra strength. To avoid unnecessarily complicating the figures, not all of the tubes 14U and 14B, compartments 16U and 16B, and gussets 18 have been labeled, this procedure also being followed for numerous other parts discussed below.

The storage rack 10 includes a front 10F, a back 10B, right side 10R and left side 10L. Pivotable right and left handles 20R and 20L are mounted on opposite sides of the projectile storage rack 10. The pivotable handles 20R and 20L are part of the gang lock mechanism 12. As described in detail below, the gang lock mechanism 12 may be used to lock projectiles within the projectile storage tubes 14U and 14L.

The pivotable handles 20R and 20L pivot at respective pivot points 22R and 22L with pivot rod 24 extending therebetween. The pivot points 22R and 22L are mounted to respective pivot sleeves 26R and 26L. Sleeves 26R and 26L are in turn mounted on the pivot flanges 28R and 28L welded to the back 10B of the storage rack 10.

The gang lock mechanism 12 further includes right and left activation plates 30R and 30L having respective mounting points 32R and 32L bolted to the respective pivotable handles 20R and 20L at points 34R and 34L. Upper and lower activation rods 36U and 36B extend between the two activation plates 30R and 30L. Capture rods 38U and 38B are respectively mounted upon the under side of the activation rods 36U and 36B. For ease of illustration, the capture rods 38U and 38B are shown in shortened form in FIG. 5.

Figure 2:
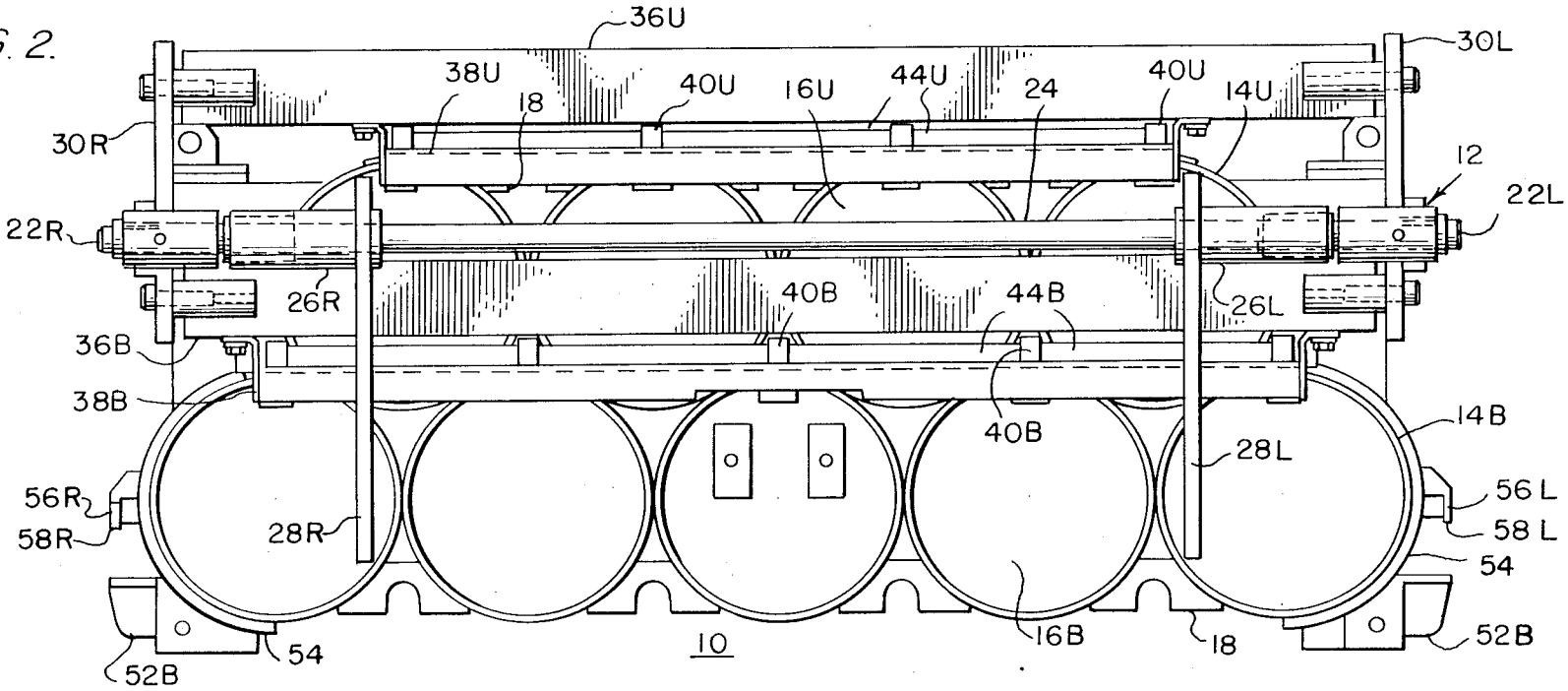
FIG. 2 shows a back view of the storage rack and gang lock mechansim.

Disposed to extend between the upper activation rod 36U and the upper capture rod 38U are a number of upper locking bars 40U (only one shown in FIG. 5) which are pivotably mounted to flanges 42U disposed adjacent the front 10F of the storage rack 10. Likewise, a number of lower locking bars 40B (not shown in FIG. 5) are captured between capture rod 38B and activation rod 36B, these locking bars being pivotably mounted at flanges 42B. As best shown in FIG. 2, the gang locking mechanism 12 includes a locking bar 40U or 40B associated on a one-to-one basis with each of the cylindrical tubes 14U or 14B. The locking bars 40U and 40B are made of high strength steel and disposed directly on top of the corresponding storage tube 14U or 14B.

In addition to being captured between the activation rod 36U and capture rod 38U, each of the locking bars 40U is spaced from the other locking bars 40U by spacer bars 44U which serve to generally maintain the locking bars 40U parallel to the corresponding cylindrical tubes 14U. As best shown in FIG. 2, spacer bars 44B perform the same function with respect to the lower locking bars 40B. The spacer bars 44U and 44B may be welded or bolted to the corresponding capture rods 38U or 38B. Alternately, the spacer bars 44U and 44B could be deleted and the capture rods 38U and 38B or activator rods 36U or 36B could simply include notches for seating the corresponding locking bars.

Figure 1:
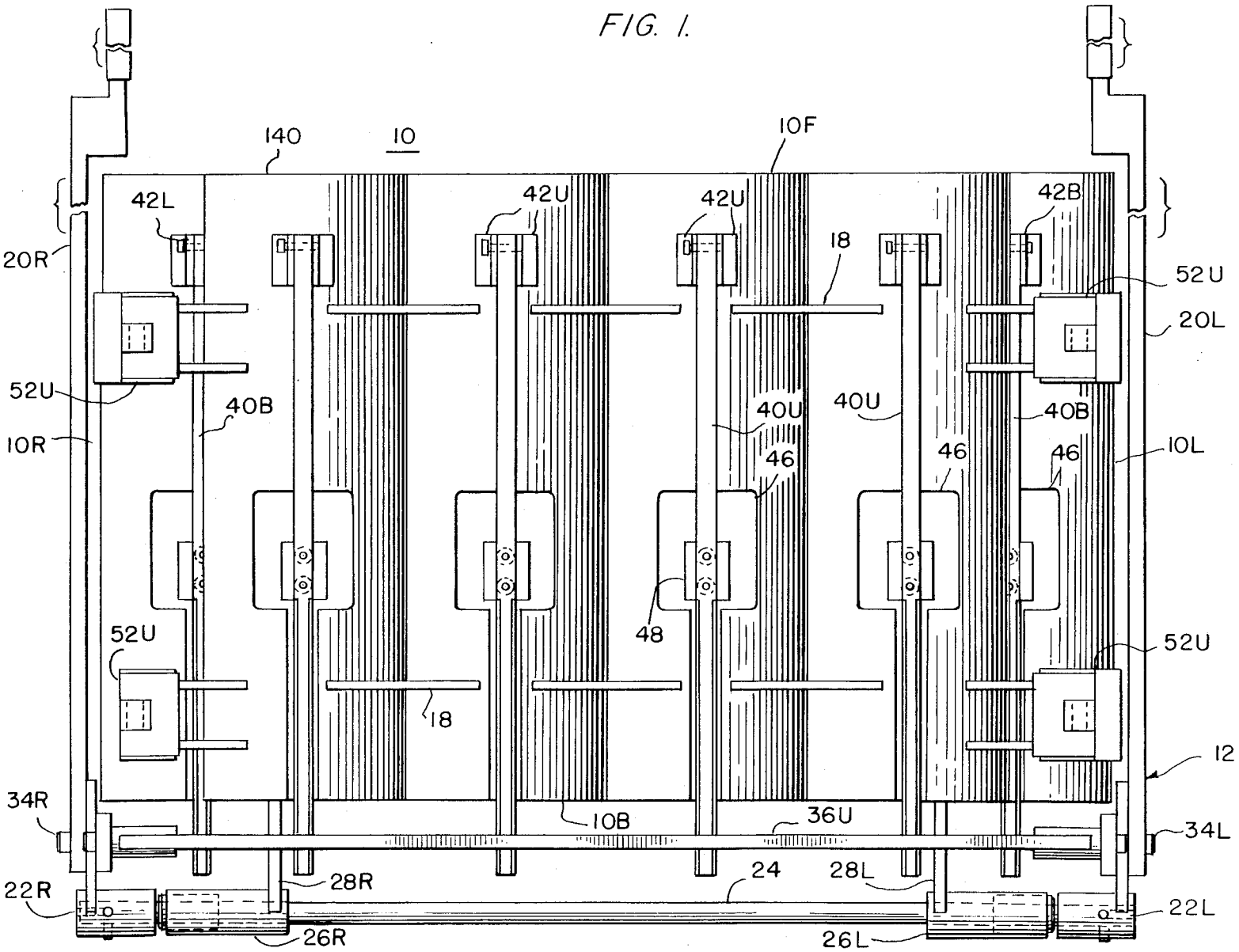
FIG. 1 shows a top view of a projectile storage rack and associated gang lock mechanism according to the present invention.
Figure 4:
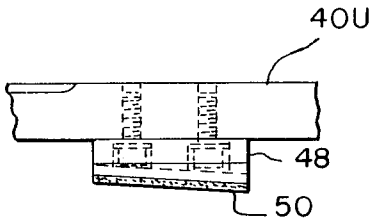
FIG. 4 shows a side view of a clamping surface or shoe arrangement used with the gang lock mechanism of FIGS. 1–3.
Figure 3:
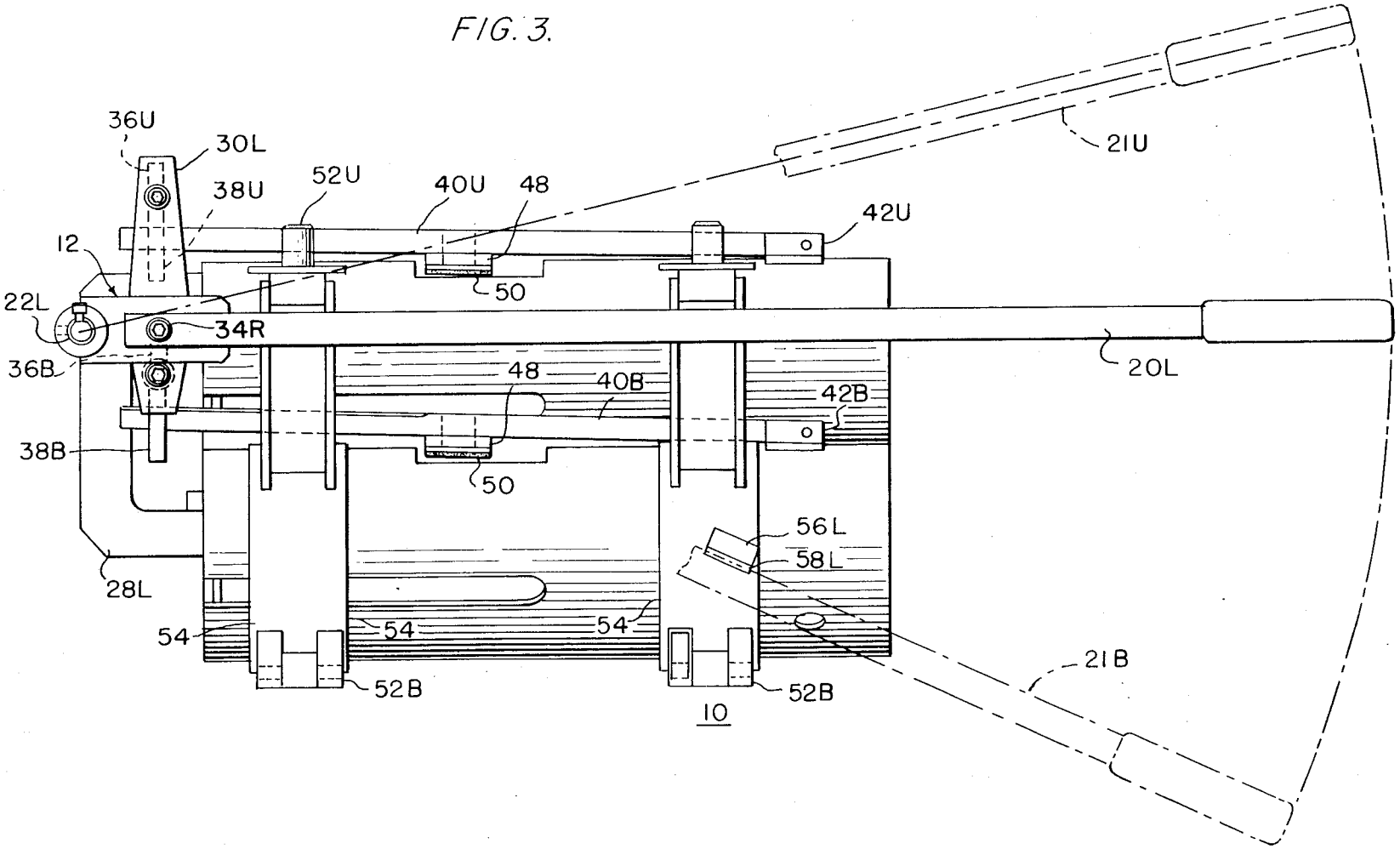
FIG. 3 shows a side view of the storage rack and gang lock mechanism.
Figure 5:
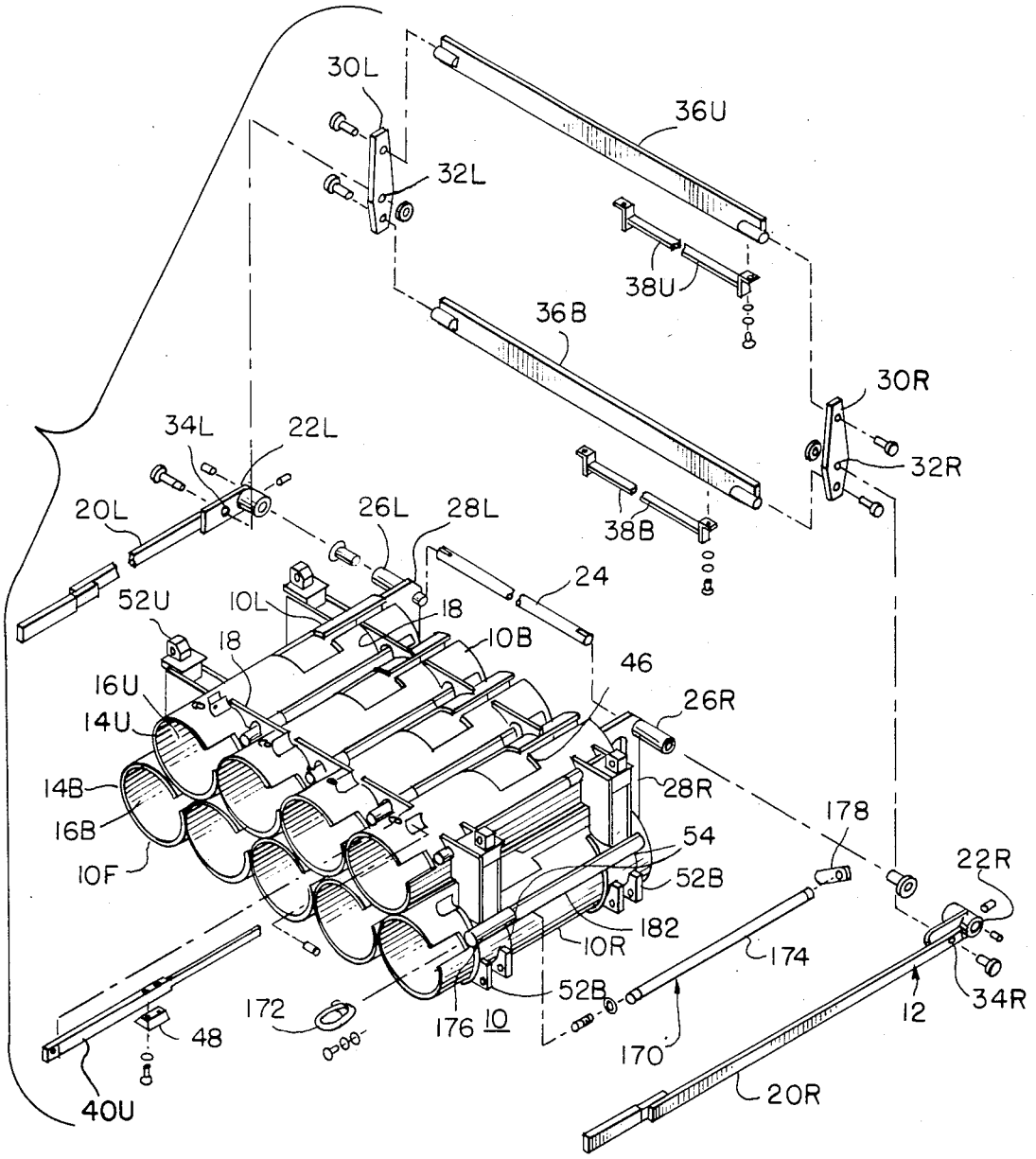
FIG. 5 shows a simplified exploded view of various parts of the storage rack and gang lock mechanism shown in FIGS. 1–3.

As best shown in FIGS. 1 and 5, each of the cylindrical tubes 14U and 14B includes a cut out portion 46 in the shown pattern to accommodate the corresponding locking bar 40U (or 40B). Above a rectangular portion of the cut out 46 is a shoe 48 which is bolted to the underside of the locking bar 40U (or 40B) as best shown in the left side detail view of FIG. 4. At the bottom of the shoe 48 is a clamping surface 50 made of rubber or similar material. As shown in FIGS. 3 and 4, the shoe 48 is thicker at its front end such that clamping rubber surface 50 will generally match the projectile surface. (not shown). Additionally, the rubber clamping surface 50 is cylindrically curved to mate with the curve of a projectile.

Upper and lower leg portions 52U and 52B are disposed at the right and left sides 10R and 10L and may be used for bolting the projectile rack 10 above and/or below an indentically constructed projectile rack. Straps 54 are used to weld the leg portions 52U and 52B to the correspondng end lower tubes 14L. Additionally, as best shown in FIGS. 2 and 3, the front straps 54 have lock flanges 56R and 56L welded to them. As best shown in FIG. 3, the locking flange 56L (or similar locking flange 56R) is used to lock the pivotable handle 20L in a lower position 21B shown in dotted lines in FIG. 3. Referring also to FIG. 2, it should be noted that the pivotable handles 20L and 20R may be swung out away from the projectile storage rack 10 slightly in order to clear 56L and 56R and pushed back towards the projectile storage rack 10 such that they are captured by the lips 58L and 58R disposed on the locking flanges 56R and 56L. In addition to the lower position 21B in phantom line in FIG. 3, the left pivotable handle 20L is also disposable in an upper position 21U also shown in phantom line in FIG. 3. In this upper position, the handle 20L will be disposed above the front left portion 52U. The right handle 20R has corresponding upper, lower, and intermediate positions.

Operation

The operation of the embodiment of FIGS. 1–5 is relatively straight forward. Initially, the handles 20L and 20R are disposed in their upper positions (corresponding to 21U in phantom line in FIG. 3). The activation plates 30L and 30R are lifted above the position for the activation plate shown in FIG. 3 since the activation plates 30L and 30R are attached to points 34R and 34L on the corresponding pivotable handles 20R and 20L. The lifting of the activation plates 30R and 30L causes the activation rods 36U and 36B to be lifted. Since the upper and lower locking bars 40U and 40B are captured between the activation rods 36U and 36B and the associated capture rods 38U and 38B, all of the locking bars 40U and 40B will be lifted as will the clamping surfaces 50 disposed on the shoes 48 attached to the locking bars. Projectiles may then be loaded into the individual cylindrical cylinders 14U and 14L. Each of the cylinders holds a single projectile (not shown) with its nose extending out from the front 10F. When the desired number of projectiles (up to a maximum of 9 for the embodiment of FIGS. 1–5) have been loaded into the rack 10, the gang locking mechanism 12 may be used to lock all of the projectiles in place. More specifically, the handles 20L and 20R may be moved from their upper positions (21U in FIG. 3) to their lower positions (21B in FIG. 3). This in turn lowers the activation plates 30R and 30L and the activation rods 36U and 36B. Since the locking bars 40U and 40B are captured to move with the activation rods 36U and 36B, the locking bars 40U and 40B will rotate counterclockwise about the corresponding respective pivot flanges 42U and 42B. This downward motion or rotation of locking bars 40U and 40B causes the clamping surfaces 50 to be brought into tight contact with any projectile disposed within one of the storage tubes 14U and 14B. The gang lock mechanism 12 thus will have locked the projectiles in place by use of the clamping surfaces 50 and the other components of the gang lock mechanism 12. These other compartments may be considered as an operator mechanism which is disposable in an activation position (both handles 20L and 20R in the lower position 21B of FIG. 3) and an inactivation position (both handles in the upper position 21U or the intermediate position shown in solid line in FIG. 3). Corresponding to the activation and inactivation positions of the operator mechanism, the clamping surfaces 50 will be disposed in either a lower clamping position or an upper non-clamping position.

It should be noted that each of the handles 20R and 20L may be lowered and locked into their lower positions one at a time.

The rotation of one of the handles will cause the other handle to rotate somewhat by virtue of the pivot rod 24 which connects handles 20R and 20L. However, the rotation will not be completely transmitted from one handle to the other since pivot rod 24 will be placed under a torsion which twists it. By providing two handles 20R and 20L, the clamping force on each of clamping surfaces 50 will be relatively uniform.

An extension bar (not shown) may be inserted to mate with either of the locking handles 20R and 20L and used to gain additional leverage in operating the pivotable handles 20R and 20L. However, the use of the extension bar may not be required depending on the location of the ammo rack, and if basic mechanical advantage of the gang lock mechanism 12 is very high. More specifically, a particular working embodiment of the present invention has been used to generate 300 lbs of clamping force on each of the clamping surfaces 50. Since there are 9 clamping surfaces 50 (one for each of the tubes 14U and 14B), this embodiment provides 2700 lbs of clamping force in total. The manually operable handles 20L and 20R only require 120 lbs each in order to lock them into position. Especially since the 120 lbs may be directed downwardly in order to move the levers from the 21U position to 21B in FIG. 3, a soldier may use his weight easily in order to provide this 120 lbs first for one of the handles and then for the other of the handles. Accordingly, the mechanical advantage of this system is 2700 lbs of clamping force for 240 lbs of manual applied force which is equal to 90/8 or better than 10 to 1.

An important feature of the present invention is that the gang lock mechanism 12 takes up a minimal amount of space and is sufficiently unobtrusive that numerous of the projectile racks 10 may be mounted and pinned one on top of another by virtue of the leg portions 52U and 52B. Further, the projectile rack 10 may include flanges or supports (not shown) which may be used to bolt it to a sidewall of a vehicle and/or to a ceiling of a vehicle.

When the storage rack 10 has been used to convey the projectiles to a location where they are to be used, the unloading of the storage rack 10 is quite simple. The handles 20L and 20R are simply moved from their locking positions 21B in FIG. 3 to the intermediate position as shown in solid line for 20L in FIG. 3. Alternately, the handles 20L and 20R could be moved all the way up to their loading position 21U shown in dotted line in FIG. 3. In either case, the raising of the handles 20L and 20R in turn raises the activation plates 30L and 30R, activation rods 36U and 36B, locking bars 40B and 40U, and clamping surfaces 50. Thus, the projectiles may be freely removed from the projectile storage tubes 14U and 14B without interference from the rubber clamping surface 50 on the shoes 48. If after unloading some of the projectiles, it is necessary to move the vehicle carrying the storage rack 10, the remaining projectiles can easily be relocked in place by simply lowering the handles 20R and 20L in the manner as described above.

Alternate Embodiment

Figure 8:
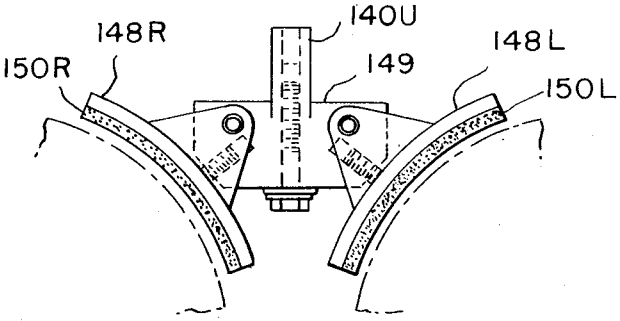
FIG. 8 shows a clamping surface or shoe arrangement as taken along lines 8—8 of FIG. 6.
Figure 6:
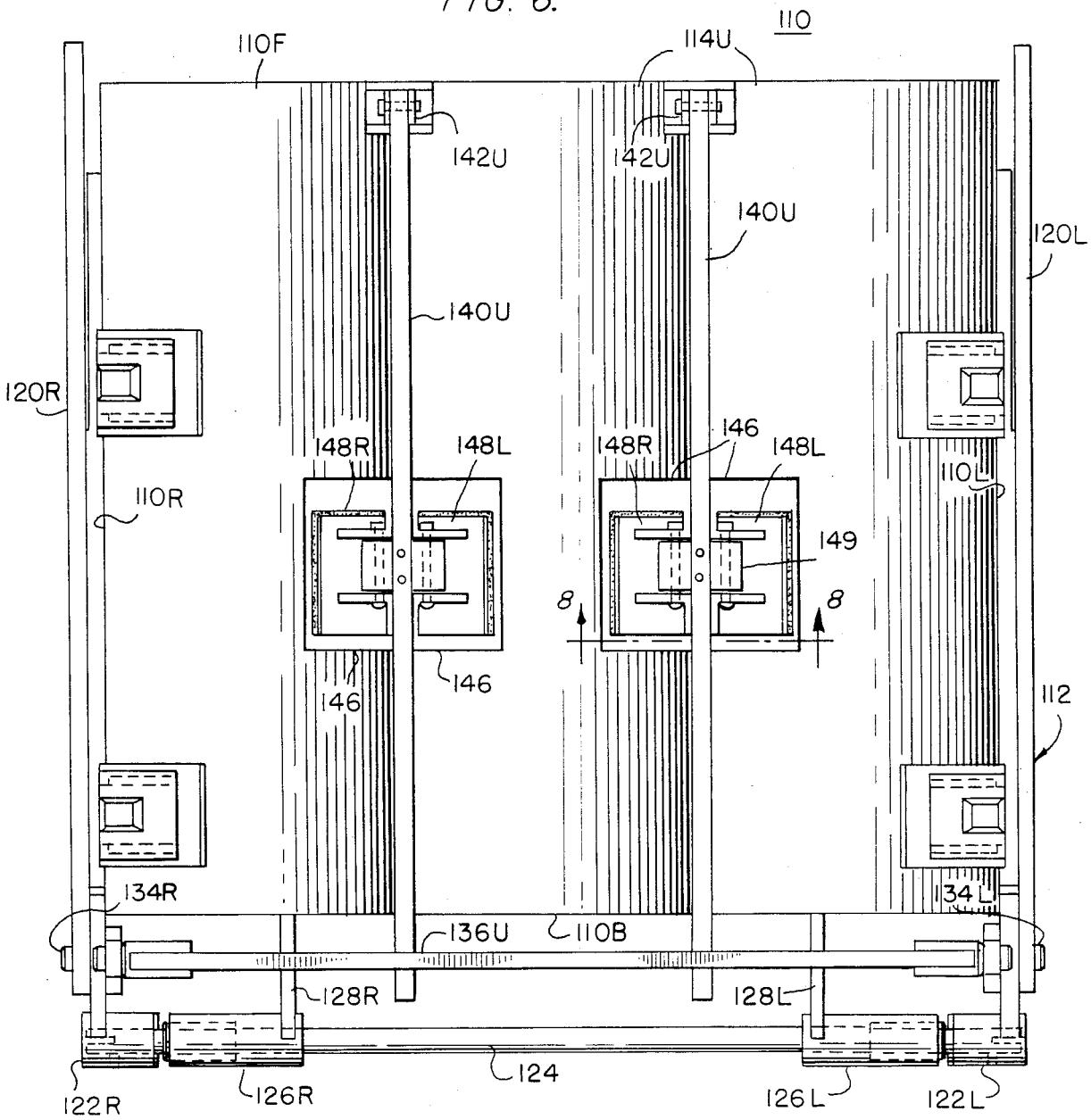
FIG. 6 shows a top view of an alternate embodiment storage rack and gang lock mechanism.
Figure 7:
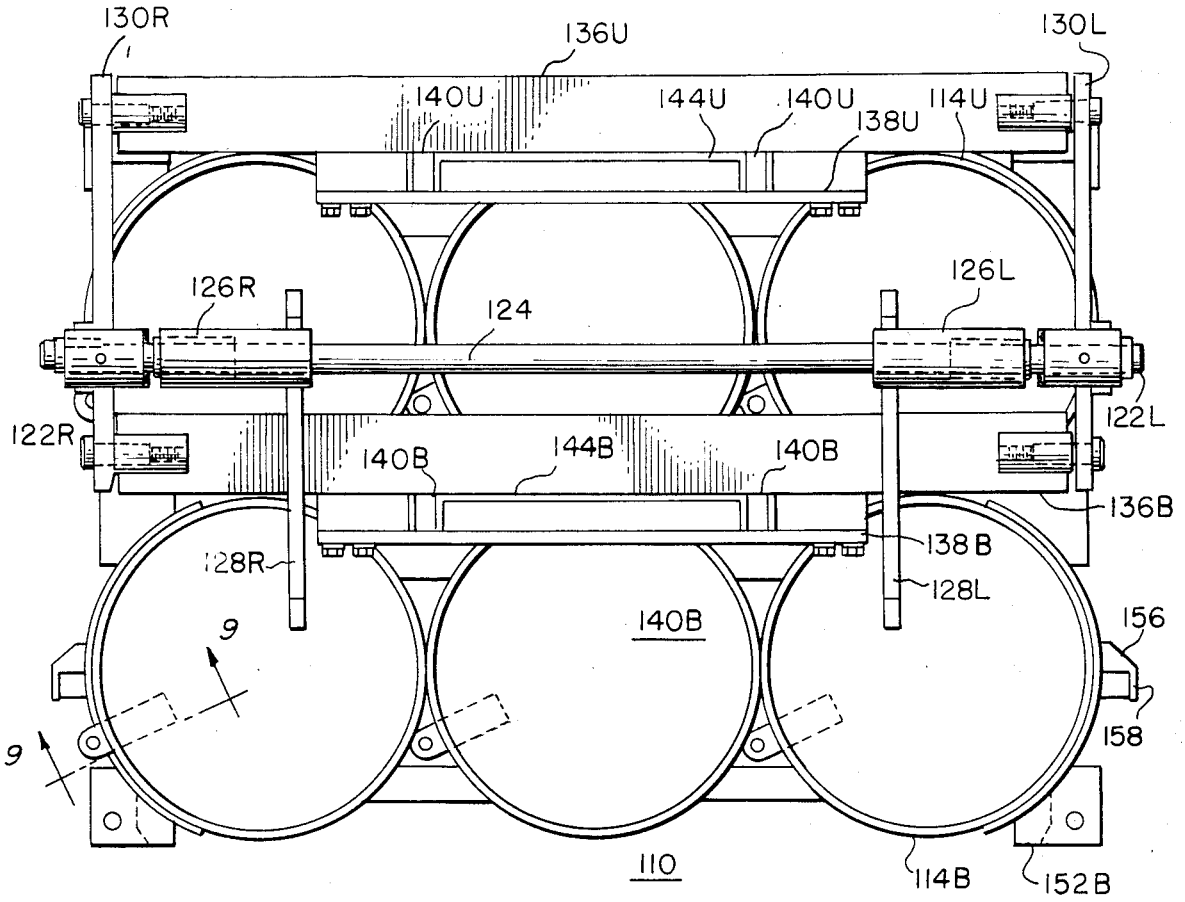
FIG. 7 shows a back view of the alternate embodiment.

Turning now to FIGS. 6–8, an alternate embodiment of the present invention will be described. Since numerous of the parts of the alternate embodiment correspond to similar parts in the embodiment of FIGS. 1–5, the parts of the FIGS. 6–8 embodiment have been labeled in the 100 series with the same last two digits as the corresponding part of the first embodiment. Thus for example, the storage rack 110 includes three upper storage tubes 114U and three lower storage tubes 114B. To avoid unnecessary repetition, the description of the alternate embodiment will simply concentrate on the differences between the alternate embodiment 110 and the embodiment 10 shown in FIGS. 1–5.

Basically, the embodiment 110 is identical to the embodiment 10 except that the storage rack 110 has 2 rows of 3 parallel cylindrical tubes 114U and 114B and uses fewer locking bars 140U and 140B. Instead of staggering the cylindrical tubes as with the storage rack 10, the storage rack 110 uses upper tubes 114U which are centered over a center of a corresponding lower tube 114B. Additionally, the locking bars 140B and 140U each support two shoes 148 as best shown in FIGS. 6 and 8. The shoes 148L and 148R are mounted to the locking bar 140U by way of a support block 149. The clamping surfaces 150R and 150L are respectively mounted upon the shoes 148R and 148L. As with the clamping surfaces 50 of the rack 10, the clamping surfaces 150L and 150R are cylindrically curved to match the cylindrical curve of a projectile. Also, they are curved or inclined to match the taper of a projectile. As best shown in FIG. 6, the cut out portions 146 in the cylindrical tubes 114U and 114B allow the shoes 148R and 148L to move into and out of contact with projectiles disposed within the tubes. Further, the locking bars 140U and 140L are disposed to pivot about pivoting flanges 142U which are welded or otherwise mounted between adjacent ones of the tubes 114U and 114B.

The operation of the embodiment of FIGS. 6–8 is identical to that of the embodiment of FIGS. 1–5 except that each locking bar 140U and 140B may be used to lock two projectiles. In contrast, the embodiment of FIGS. 1–5 uses locking bars 40U and 40B associated on a one-to-one basis with the projectiles and storage tubes.

Figure 9:
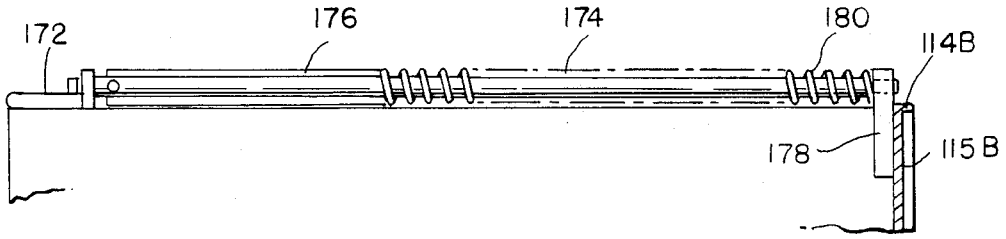
FIG. 9 shows a side view of a projectile extractor device as optionally used with the present invention.

Turning now to FIG. 9 and continuing to consider FIG. 7, a projectile extracting device 170 will be discussed. This optional projectile extracting device 170 is also shown in exploded form on rack 10 of FIG. 5. The projectile extracting device 170 includes a manually operable pull ring 172 which is secured to a pull rod 174 extending through sleeve 176. The sleeve 176 is preferably welded to the side of one of the tubes 14U, 14B, 114U, or 114B as best shown in FIG. 5. A removal piece 178 is attached to the back of the pull rod 174. A spring 180 biases the pull ring such that the removal piece 178 is in contact with a back wall portion 115B of the cylindrical tube 114B (or 114U, 14B, or 14U). A cut out portion 182 shown only in FIG. 5 allows the removal piece 178 to slide parallel to the axis of the cylindrical storage tube.

The optional projectile extraction device 170 provides for easy removal of a projectile disposed within one of the cylindrical storage tubes. In particular, after unlocking the gang lock mechanism 12 or 112, the pull ring 172 is pulled forward such that pull rod 174 moves forward, thereby biasing spring 180. Removal piece 178 likewise moves forward and effectively translates the pulling force on pull ring 172 into a pushing force to the back of a projectile. The removal piece may slide in channel or cut out portion 182 until the projectile is sufficiently out of the cylindrical storage tube for easy direct manipulation. Thus, if the projectile is too heavy to allow easy manual manipulation directly by the nose of the projectile when it is disposed within the storage rack 10 or 110, the optional projectile extraction device 170 may be used for facilitating removal of the projectile. The spring 180 causes the pull rod 174 to snap back to the position of FIG. 9 with piece 178 against back wall 115B.

Although specific constructions have been described herein, it is to be understood that these are for illustrative purposes only. Various modifications and adaptations will be readily apparent to those of ordinary skill in the art. Accordingly, the scope of the present invention should be determined by reference to the appended claims.

What is claimed is:

1. A projectile storage rack having a front, a back, a right side, and a left side and comprising:

(a) a plurlity of parallel projectile storage compartments (b) a plurality of clamping surfaces, each clamping surface associated on a one-to-one basis with one of said storage compartments, each clamping surface movable between:

(i) a clamping position in which it is operable to contact and clamp a projectile within its associated storage compartment, and (ii) a non-clamping position such that projectiles may be freely inserted and removed from the associated storage compartment;

(c) an operator mechanism operable to move more than one of said clamping surfaces between their respective clamping positions and non-clamping positions, said operator mechanism disposable in:

(i) an activation position in which said operator mechanism disposes said more than one clamping surfaces in their clamping positions, and (ii) an inactivation position in which said operator mechanism disposes said more than one clamping surfaces in their non-clamping positions, said operator mechanism being lockable in said activation position; and further comprising a plurality of parallel cylindrical tubes extending axially front to back and defining said plurality of projectile storage compartments, said operator mechanism including a plurality of locking bars extending lengthwise front to back, each locking bar pivotably mounted on its front end to at least one associated tube to allow vertical movement of each locking bar at its back end, each clamping surface movable up and down by movement of one of said locking bars; said locking bars are pivotable by operation of said operator mechanism; and wherein said operator mechanism is operable for moving a plurality of clamping surfaces from their clamping positions to their non-clamping positions.

2. The projectile storage rack of claim 1 wherein said operator mechanism includes at least a pivotable first handle extending from said front towards said back.

3. The projectile storage rack of claim 2 wherein said operator mechanism includes a pivotable second handle, said first and second handles disposed on opposite sides of said projectile storage rack and pivotable about a common pivot axis extending between right and left at the back of said projectile storage rack.

4. The projectile storage rack of claim 3 wherein said operator mechanism includes at least a first activation rod extending right to left and disposed at said back, said first activation rod movable up and down as said operator mechanism changes position.

5. The projectile storage rack of claim 1 wherein said plurality of projectile storage compartments are arranged in at least two rows, and said operator mechanism is operable to move clamping surfaces associated with storage compartments in said at least two rows; and each clamping surface is mounted to one of said locking bars.

6. The projectile storage rack of claim 1 wherein said operator mechanism has a mechanical advantage of at least 10:1.

7. The projectile storage rack of claim 1 further comprising a plurlaity of projectile extracting rods, each projectile extracting rod attached to an associated one of said cylindrical tubes and operable to remove a projectile from said associated one of said cylindrical tubes.

8. A projectile storage rack having a front, a back, a right side, and a left side and comprising:

(a) a plurality of parallel projectile storage compartments extending axially front to back and arranged in at least one row;

(b) a plurality of clamping surfaces, each clamping surface associated on a one-to-one basis with one of said storage compartments, each clamping surface movable between:

(i) a clamping position in which it is operable to contact and clamp a projectile within its associated storage compartment, and (ii) a non-clamping position such that projectiles may be freely inserted and removed from the associated storage compartment;

(c) an operator mechanism operable to move more than one of said clamping surfaces between their respective clamping positions and non-clamping positions, said operator mechanism disposable in:

(i) an activation position in which said operator mechanism disposes said more than one clamping surfaces in their clamping positions, and (ii) an inactivation position in which said operator mechanism disposes said more than one clamping surfaces in their non-clamping positions, said operator mechanism being lockable in said activation position, and wherein said operator mechanism includes at least a first pivotable handle extending lengthwise front to back, and wherein said plurality of projectile storage compartments are arranged in at least two vertically spaced rows, and said operator mechanism is operable to move clamping surfaces associated with storage compartments in said at least two rows, and wherein said operator mechanism includes a plurality of locking bars extending lengthwise front to back and wherein each of said clamping surfaces is mounted to one of said locking bars.

9. The projectile storage rack of claim 8 wherein said operator mechanism includes at least a horizontal first activation rod extended right to left and disposed at said back, said first activation rod movable up and down as said operator mechanism changes position and wherein said first activation rod is operable to cause at least some of said locking bars to pivot upon pivoting of said first pivotable handle.

10. The projectile storage rack of claim 9 wherein said operator mechanism includes a second activation rod extending right to left and disposed at said back, said second activation rod movable up and down as said operator mechanism changes position, and said second activation rod is operable to cause at least some of said locking bars to pivot.

11. The projectile storage rack of claim 9 further comprising a horizontal second activation rod extending right to left and disposed at said back, said second activation rod movable up and down as said operator mechanism changes position, and movement of said second activation rod causes a change in position of at least some of said clamping surfaces, and wherein said first activation rod is operable to activate said clamping surfaces associated with one of said rows and said second activation rod is operable to activate said clamping surfaces associated with another of said rows.

12. The projectile storage rack of claim 11 wherein each of said locking bars is associated with one of said at least two rows, and each locking bar is pivotably mounted and is secured to an associated one of said first and second activation rods for pivoting upon up and down movement of said associated one of said first and second activation rods.

13. The projectile storage rack of claim 9 wherein said operator mechanism includes a first activation plate mounted on said first handle and wherein first activation rod is mounted to said first activation plate.

14. The projectile storage rack of claim 8 wherein said operator mechanism includes a pivotable second handle, said first and second handles disposed in opposite sides of said projectile storage rack and pivotable about a common pivot axis extending between right and left at the back of said projectile storage rack.

15. The projectile storage rack of claim 8 wherein said operator mechanism has a mechanical advantage of at least 10:1.

16. The projectile storage rack of claim 8 wherein said operator mechanism is operable for moving a plurality of clamping surfaces from their clamping positions to their non-clamping positions.

* * * * *

UNITED STATES PATENT AND TRADEMARK OFFICE

CERTIFICATE OF CORRECTION

PATENT NO. : 4,655,668

DATED : April 7, 1987

INVENTOR(S) : Perisastry et al

It is certified that error appears in the above-identified patent and that said Letters Patent is hereby corrected as shown below:

Column 9, Line 57, "plurlity" should be --plurality--.
Column 10, line 53, "plurlaity" should be --plurality--.

Signed and Sealed this

Thirteenth Day of October, 1987

*Attest:*

DONALD J. QUIGG

*Attesting Officer*

*Commissioner of Patents and Trademarks*